United States Patent [19]

Voelkel

[11] Patent Number: 4,829,926

[45] Date of Patent: May 16, 1989

[54] PONTOON BOAT HAVING A COLLAPSIBLE FORM

[76] Inventor: Hilton L. Voelkel, P.O. Box 349, Blessing, Tex. 77419

[21] Appl. No.: 122,841

[22] Filed: Nov. 19, 1987

[51] Int. Cl.[4] ..... B63B 1/12; B63B 7/04

[52] U.S. Cl. ..... 114/61; 114/352; 114/354

[58] Field of Search ..... 114/61, 344, 352, 354

[56] References Cited

U.S. PATENT DOCUMENTS

| | | | |
|---|---|---|---|
| 3,042,942 | 7/1962 | Howe | 114/344 |
| 3,193,851 | 7/1965 | Fiebelborn | 114/344 |
| 4,040,134 | 8/1977 | Downing | 114/61 |

*Primary Examiner*—Sherman D. Basinger
*Attorney, Agent, or Firm*—Alexander F. Norcross

[57] ABSTRACT

A pontoon boat, of the type having two pontoons upon which is erected a platform and railing, for use as a shallow draft vessel, is shown having the platform and railings contructed of a particular collapsible construction specifically adapted for rapid, complete and compact disassembly for ease of over-the-road transportation. Each pontoon is constructed of two end-to-end canoe shaped flotation structures having a perpendicular end for abutment and bolting together, and a tapered end for lessening water drag. On a flat top of each pontoon, mating left and right receiving support points hold the collapsible platform frame. Two identical, facing collapsible platform frames have pin and socket connections for interlinking with the pontoons, and have a removable floor plate which rests in a hinged bottom support frame. The bottom frame and two hinged side rail sections fold against a fixed back rail. The proportions of all components are chosen so that the side rails fold directly against the back frame and the bottom support frame folds up producing a flat, easily transported structure. The resulting structure is compact and easily transported when broken down, but provides for a substantially strong rail form the pontoon platform when erected.

6 Claims, 4 Drawing Sheets

PONTOON BOAT HAVING A COLLAPSIBLE FORM

BACKGROUND OF THE INVENTION

A common form of shallow draft vessel for use by sportsmen and fisherman in wetlands and estuaries is the pontoon boat. In practice, the pontoon boat consists of two parallel flotation pontoons, usually cylindrical in aspect, upon which is erected a flat platform deck and some form of railing to reduce the chance of the occupant from falling overboard. Such vessels are capable of providing very large working deck areas at relatively low cost and at relatively small draft. While the vessels are of limited seaworthiness, compared to a catamaran, they are relatively maneuverable at low speed and minimize draft for the amount of usable deck space provided. Various forms of such pontoon boats are known, including boats with enclosed cabins on the deck and various multi-passenger tour boats.

The relatively large platform size of such a pontoon boat makes the boat extremely unwieldy for over-the-road transportation when it becomes necessary to move the boat from one water location to another. Since pontoon boats are typically utilized in bayous and in tidewater wetlands, it is generally necessary to transport the boat over the road to a launching point.

For this reason, considerable effort has been spent in coming up with forms of collapsible or disassembleable pontoon boats which can be broken down to a readily transportable form and then built up to a usable structure at the point of launch.

For instance, U.S. Pat. No. 4,562,786 to Pruonto shows a collapsible pontoon boat, and specifically describes a pontoon deck assembly of removable panels. The patent delineates a specific structure of side rails for attaching and securing the deck panels to the pontoons. Passenger protective railing, erected on the deck, consists of a plurality of removable posts between which a lifeline is run. The resulting structure thus has a plurality of relatively small parts, and a relatively weak passenger protective railing.

U.S. Pat. No. 3,614,937 to Schulman shows a collapsible pontoon boat structure in which the pontoons are constructed in sections, abutted end to end, and interconnected by fastening to a continuous rail structure which forms a base of the deck section. Inasmuch as the entire strength and connectivity of the vessel is by means of an integrated deck structure, a removable deck panel structure would not be available with this form of construction.

Downing, U.S. Pat. No. 4,040,134, shows an eariler pontoon boat in which the individual pontoon sections are permanently affixed to a rigid deck structure, but may be folded over the structure to produce smaller external dimensions; the passenger protection rail structure, in the case of Downing, consists of individual removable side panels.

Other similar structures are shown for folding pontoon boats in U.S. Pat. No. 3,179,960 in which an X-shaped under deck structure provides the strength and rigidity permitting removble deck panels and removable pontoons to be interconnected to form a suitable boat, and U.S. Pat. No. 3,978,536 showing a boat that is foldable about a mid-deck hinge point running parallel to and between the pontoons.

Similar patents have shown various folding structures for use with catamarans or similar multi-hull vessels, including U.S. Pat. Nos. 4,223,621; 4,337,543; 4,662,297, and 3,608,112.

Each of the preceding structures has a significant disadvantage in that either the pontoon boat is maintained as an entity with certain sections folded inward to reduce dimension, but otherwise remains at full size, or the pontoon is shown as being disassembled into a relatively large number of small parts, all of which must be accounted for and maintained in order to provide for reconstruction of the vessel. In addition, set up time increases in direct proportion to the total number of components involved and the number of joints and interconnections decreases the reliability of the entire structure. In addition, most of the structures shown do not provide for sufficiently rigid passenger protection rails. Since pontoon boats are typically multi-passenger affairs and are often used for families, who will have small children aboard, the nature of the rail structure surrounding the platform deck is essential to safety.

SUMMARY OF THE INVENTION

This invention relates to the field of collapsible pontoon boats and discloses a structure for collapsible pontoon boat in which the platform is constructed of two facing, folding frame members hinged so as to be folded into a relatively flat rectangular structure, of light weight and ready mobility and which can be unfolded into a light but strong platform frame having the distinct advantage that the side passenger retaining rails are both rigid and relatively strong, significantly increasing safety.

Additionally, the overall structure involves a relatively small number of relatively large disassemblable parts using a common jointing system. The overall reliability of the connection of the system is, thus, increased by the relatively small number of interconnecting joints and the chance of loss of an important part is significantly diminished.

The preferred form of the vessel consists of two parallel pontoons, each of which is constructed of a pair of end-to-end abutting, floating canoe hulled structures, each of which has a perpendicular end and a tapered end. Each pair of such structures is abutted at the perpendicular ends and fastened by means of a pair of pin and socket joints which in turn is secured by lock pin.

The two pontoons thus constructed have a relatively flat top face on which is provided, at spaced intervals, two pairs of receiving sockets. A symmetrical pair of platform frames is provided, each of which is sized to interlock via a pin and socket joint to one of the pair of provided receiving sockets on the pontoon. Each platform frame section is identical in construction, and consists of a rigid back frame which defines the width of the pontoon platform. Two side gate frames are permanently hinged to the back frame and are of a length that permits them to be folded over the back frame for storage or extended to define side rails for the pontoon deck. A plate receiving bottom frame section is also hinged to the back rail frame, but the hinge point is offset from the back rail frame a distance to permit the bottom frame section to fold up over, enclosing the side rail frames. When extended, the bottom rail frame receives and supports a platform deck plate.

In use, the two pontoons are assembled and each of the pairs of pontoon deck frames is unfolded and interlocked to the pontoons. Lock pins are used to secure the pin and socket joints, providing a rigid interconnection of pontoon and pontoon frame sections. The open pontoon frame sections are spaced along the pontoons so as to create three identical deck plate receiving frames, and three deck plates are placed with the frames providing a smooth pontoon deck surface. With the deck plates inserted, the unfolded side rails and back rails provide a rigid, relatively safe passenger enclosing rail, which is completed by installing a rope or chain support between adjoining side rail ends to create a boarding section.

When it is necessary to move the pontoon boat by over-the-road transportation, the pin and socket joints are unlocked, the three platform deck plates are removed, and each of the pair of deck frames is then slid free of the receiving pontoon structures. The side rails are then folded in against the back rail and the bottom frame section folded up providing two relatively flat, rectangular structures that are easily stacked. The pontoon structures are then unlocked by removing the locking pins from the pair of pin and socket joints, providing four pontoon sections.

The proportions and dimensions of the pontoons and the pontoon frames can be readily designed so that the folded pontoon frame sections, and the deck plates all have essentially identical rectangular dimensions in a ratio of 1 to 2, and in turn, the four parallel pontoon structures when placed parallel, side to side, are of a similar rectangular aspect; thus, the broken down structure can be readily stacked into an essentially rectangular pile having a length to width ratio of 2 to 1.

It is, thus, an object of this invention to show a form of collapsible pontoon boat structure which provides greater rigidity and safety in the platform deck railing.

It is a further object of this invention to disclose a form of collapsible pontoon boat which uses a smaller number of identical components.

It is a further object of this invention to disclose a structure of a collapsible pontoon boat which has greater ease and reliability in its set up and take down.

These and other objects of the invention may be clearly seen from the detailed description of the preferred embodiment which follows.

BRIEF DESCRIPTION OF THE DRAWINGS

FIG. 11 is a side view of the platform frame in the closed position.

DETAILED DESCRIPTION OF THE PREFERRED EMBODIMENT

Figure 1:
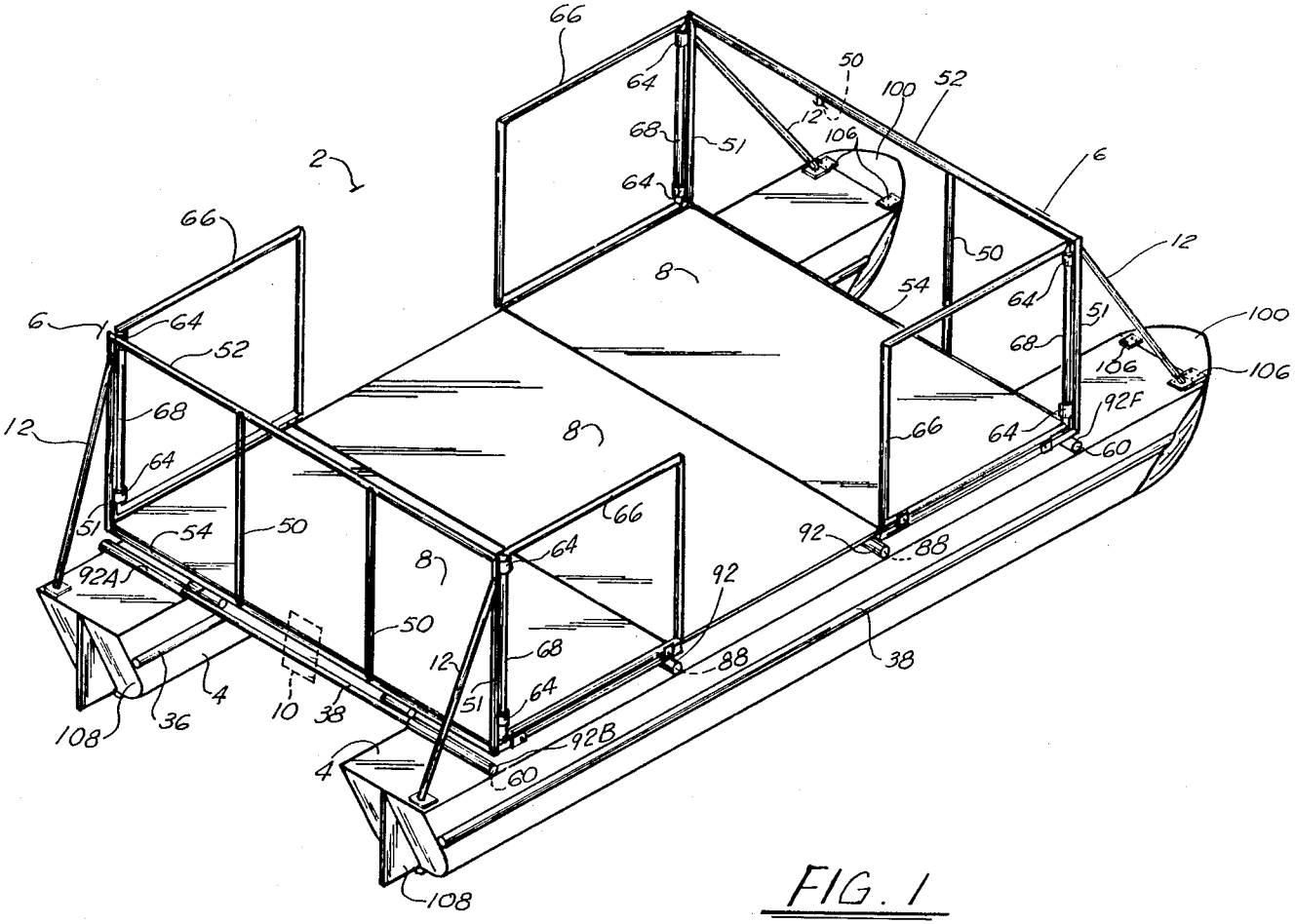
FIG. 1 is an angled view of the preferred embodiment of the invention.
Figure 2:
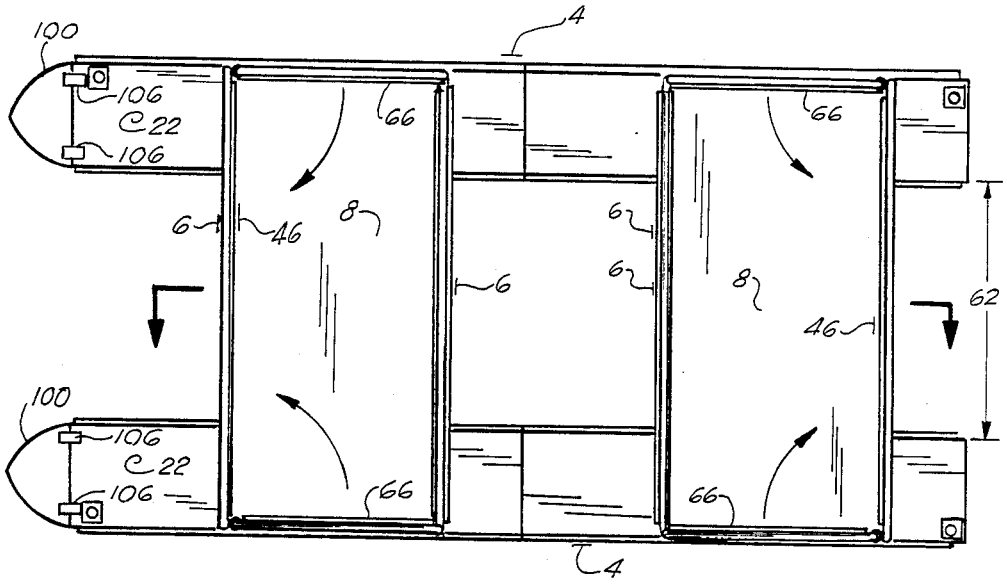
FIG. 2 is a top view of the invention.
Figure 3:
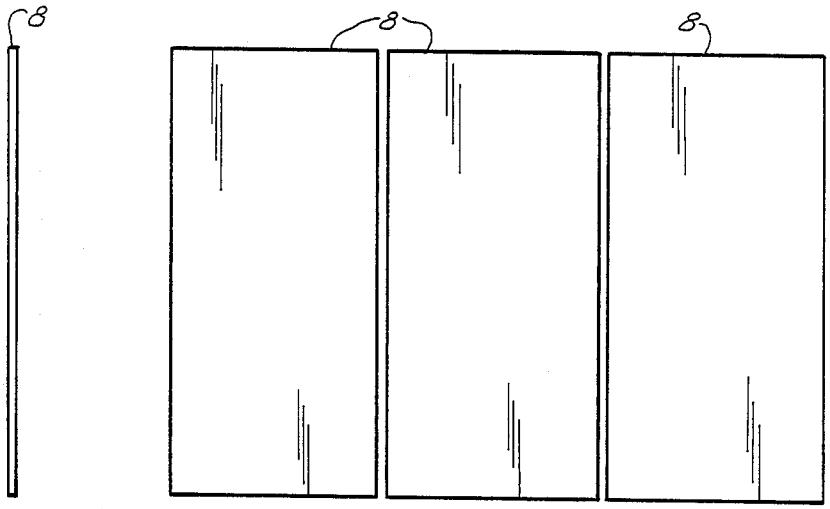
FIG. 3 is a view of the removable deck plates of the invention.
Figure 4:
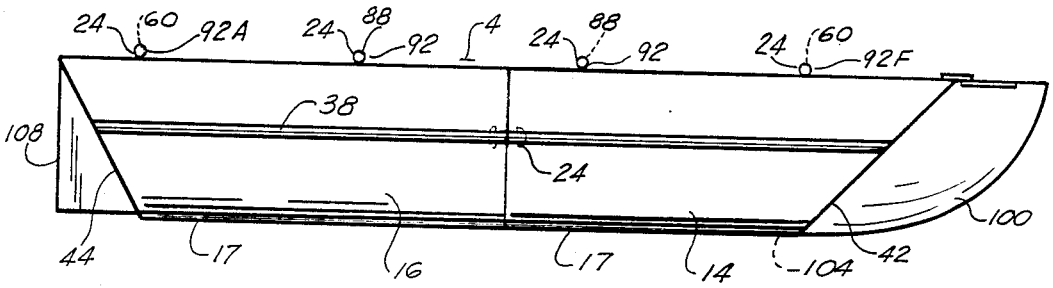
FIG. 4 is a side view of one pontoon.
Figure 5:
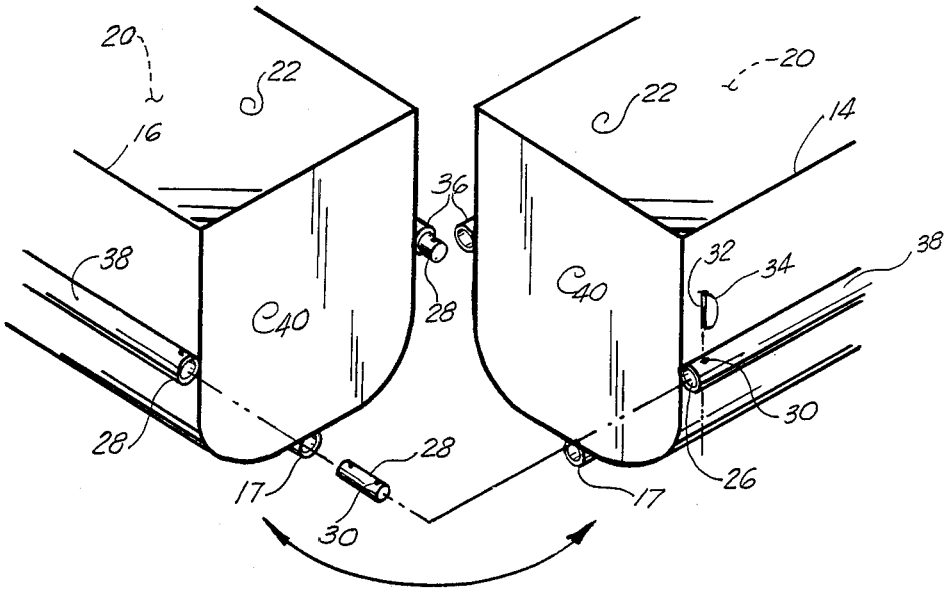
FIG. 5 is a breakaway view of the pontoons, showing the preferred method of joining.
Figure 6:
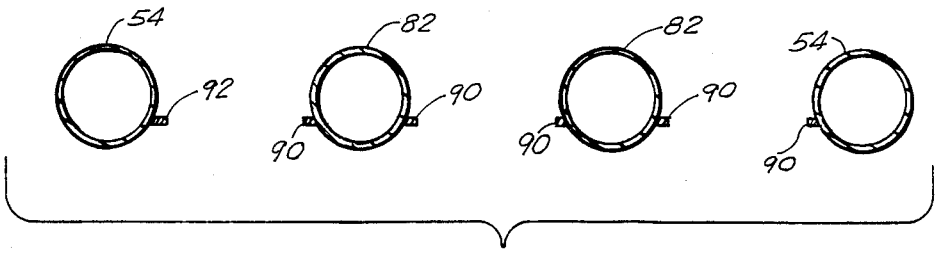
FIG. 6 is a cross section view through the bottom rail of the two facing removable platform frames showing the deck plate support bar.
Figure 7:
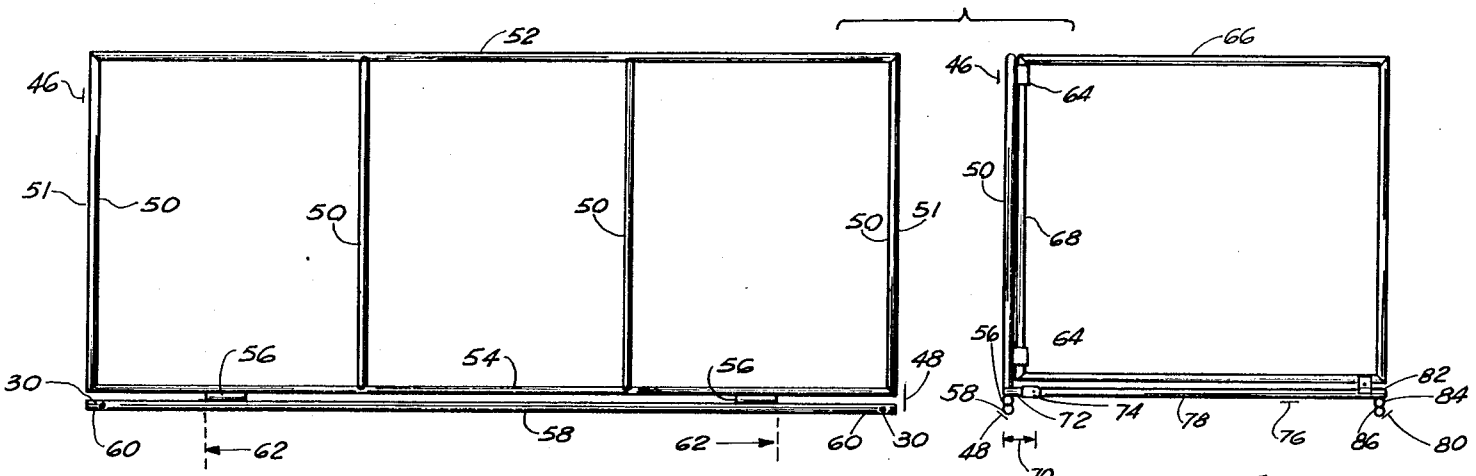
FIG. 7 is a view of the back rail frame.
Figure 10:
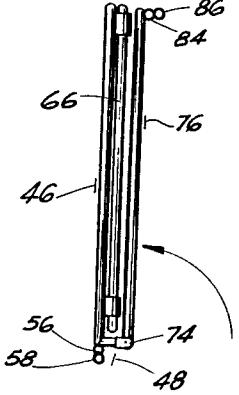
FIG. 10 is a detail showing the side frame secured to the bottom plate frame.
Figure 9:
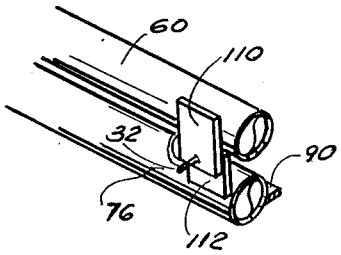
FIG. 9 is an examplar view of the hinge on the bottom plate frame.
Figure 8:
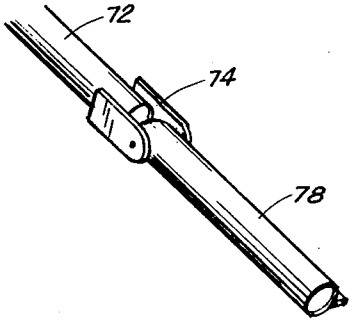
FIG. 8 is a side view of the removable platform frame.

Referring to the drawing, the pontoon boat 2 of the particular invention is seen to comprise, as major subassemblies, the pontoons 4 upon which are erected a pair of identical, facing, platform frame in which are inserted three deck plates 8. At the rear of the aftmost pontoon frame 6 is provided motor mount 10 to which will normally be affixed a standard outboard motor (not shown) of ordinary design.

Frame braces 12 extend from platform frames 6 to pontoons 4, extending in both a fore and aft bracing direction.

The particular construction of the above sub-assemblies is the invention herein claimed, and is best described in subassembly sequence.

Each of the pontoons 4 is made up of a front half section 14 and a rear half section 16. Both the front half section and the rear half section, in cross sectional shape, are essentially canoe hulled 18, and are internally filled with a flotational material 20, such as a urethane foam. Each has a flat top section 22 providing a substantially flat upper surface to the overall pontoon 4.

The interconnection of all the described structures can best be seen from the standard pin and socket joint used throughout. In each case, a typical pin and socket joint 24 consists of telescoping socket pipe end 26 which receives pin pipe end 28. At a location corresponding to the desired full insertion of pin pipe end 28 into socket pipe end 26, a locking hole 30 is drilled through both the socket and pin pipe ends. D ring locking pin 32 is inserted through locking hole 30; the wire latch 34, stretched across the outer circumference of socket pipe end 26, blocks and closes D ring 32. The pin 32, so retained, secures the socket and pin joint 24 against uncoupling.

Pipe end 28 is chosen of a size to tightly fit within socket pipe end 26. It can either be a continuous extension of an overall pipe of the appropriate diameter or may itself be a permanently affixed pipe, inserted and welded within a second pipe equal in diameter to socket pipe end 26.

This structure is, for instance, used in interconnecting front half section 14 and rear half section 16 to form pontoon 4. At a mid-line of each half section, running fore and aft, are pontoon section inner side pipe 36 and outer side pipe 38; the two together forming parallel fore and aft running pipe sections affixed to the sidewalls of the pontoon half sections (14, 16).

Both front half section 14 and rear half section 16 are constructed with a first perpendicular end face 40 and a second, angled end face 42. The pontoon half sections are abutted at mating end faces 40. A pin and socket joint 24 is formed at the point of adjoining of the respective inner side pipe 36 and outer side pipes 38 by having a pin pipe end section 28 inserted within one of the two pontoon sections inner side and outer side pipes 36, 36 and affixed there by welding or the like. The pin pipe end 28 extends for a substantial distance, at least a foot, and being inserted into and locked into socket pipe end 26 as above described, forms an inner and outer pin and socket joint 24, securing the front half section 14 to rear half section 16 forming a unified pontoon 4.

Additionally, keep pipe 17 extends longitudingly along the bottom most or keel line of both pontoon front half section 14 and rear half section 16. A pin pipe end 28 may be inserted and affixed to keel pipe 17 on one of the two sections and may telescopically extend into the keel pipe 17 of the mating pontoon half section, but this joint is not locked with a D ring 32, principally to avoid fouling of D ring 32, should grounding of the pontoons occur in use. So long as the two side joints are locked by the pin and socket joint 24, the absence of a locking pin on the joint between the two keel pipes 17 does not significantly affect the strength of the overall structure.

Pontoon front half section 14 differs from pontoon rear half section 16 in that on front half section 14, angled end face 42 is angled at twice the slope of rear angle face 44 on rear half section 16.

A removable, foam-filled canoe bow 100 is provided of a design having a particularly angled canoe shape and having a flat rear section 102 which mates with angled end face 42. A provided pipe extension 104 centrally mounted at the rear, bottom of canoe bow 100 telescopically mates into the forward keel pipe 17. A pair of providing interlocking tabs 106 are provided at the left and right front corners of front pontoon half section 14 and mating, interlocking tabs are provided at the left and right upper rear corner of canoe bow 100. These tabs, which preferably are of metallic construction, fixedly attached to the respective pontoon section or canoe bow and which interlink, are drilled to receive a D ring locking pin 32, and removably secure the canoe bow to the pontoon 4. This removable bow is of a smooth shape, and permits the ready replacement of the bow section in the event of damage from wear or permitting varying advantageous shapes to be utilized depending upon the desired performance characteristics of the overall pontoon boat 2. Thus, a relatively sharp aspect canoe bow 100 may be provided for use on relatively high speed pontoon boat 2 intended for use solely in open water free of obstacles, whereas a relatively blunt reinforced bow may be used for a pontoon boat 2 which is utilized in waters having significant obstacles, hidden snags or underwater growth.

A bendable rubber tab 108, which is constructed of a triangular metallic material, such as aluminum, is affixed to rear angle face 44 in a substantially vertical position, along a central line of pontoon 4. This attachment may be by welding or by riveting the tab through a suitable bracing material to angle face 44. The tab 108 is preferably constructed of a plate of relatively soft aluminum which is capable of being deformed to a desired position but which will otherwise hold its shape.

Folding pontoon frame 6 is constructed of a back frame 46 having a bottom transverse section 48, from which arise four equally spaced vertical support bars 50; the outer two bars form outer vertical edges 51 for back frame 46. Vertical support bars 50 terminate in and are welded to upper transverse rail 52.

Bottom transverse section 48 comprises first a bottom rail 54 to which are fixedly attached, by welding or the like, the bottom edges of vertical support bars 50 and which is parallel to and of an equal length to upper transverse rail 52.

At least two positioning spacers, which may be small pipe sections of an identical diameter to that of bottom rail 54 are spacedly affixed to bottom rail 54, and in turn are spacedly affixed to back frame pin support pipe 58. The outer two positioning spacers 56 are spaced in from the pin ends of bottom rail 54 to define a pontoon spacing distance 62, as more clearly described below. Section 48 is, in combination, rail 54, spacers 56 and pin support pipe 58.

The length of upper transverse rail 52 describes a width, and the length of vertical support bar 50 describes a height with are related in the ratio of 2 to 1, width to height.

Outer edge bars 51 have spacedly affixed, at at least two locations, extending in a direction perpendicular to the plane of back frame 46, defining a forward direction, hinge mounts 64. In the preferred embodiment of the invention hinge mounts 64 are additional sections of pipe of a size to pivotally contain side frame 66. In the preferred embodiment side frame 66 is a rectangular pipe frame having a width and a height substantially equal to the height of vertical support bar 50. One side rail of side frame 66 is the hinge rail, captively journaled within hinge point 64 so as to permanently retain side frame 66 to back frame 46 but in a position so that the inside frame 66 may pivot towards or away from back frame 46. Two such side frames 66 are installed, one on each outer edge 51, left and right, of back frame 46.

When side frame 66 is pivoted to a contacting position parallel to back frame 46, the overall thickness of its pipes defines a spacing distance 70. Extending perpendicularly forward from bottom rail 54, in the plane of outer edges 51, are spacing members 70 which may be individual pipe sections of a length equal to spacing distance 70. At the extended outer end of spacing members 72 are found bottom hinges 74 from which extends bottom plate frame 76. Bottom plate frame 76 comprises two parallel side frame rails 78, one end of each of which is pivotally affixed to hinges 74, the other end of which is fixedly attached to a forward bottom transverse section 80. Forward bottom transverse section 80 is of identical construction to bottom transverse section 48 in that it comprises a forward bottom rail 82, attached forward positioning spacers 84, which are fixedly positioned at identical distances apart to that of positioning spacers 56, and affixed to forward positioning spacers 84 forward frame pin support 86. It will be observed that pin support 86 is parallel to and in the same plane as back frame pin support 58 and that the positioning of positioning spacers 84 is such that there are defined forward pin ends 88 parallel to and extending outward an identical distance to pin ends 60.

Plate bar support member 90 is preferably welded, affixed to the bottom edge of bottom rail 54 extending in a forward direction; similar support members 90 are fixed to each of side frame rails 78 extending to an inward direction, and to forward bottom rail 83 extending both aft and forward; plate bars 90 thus form an internal lip within bottom plate frame 76 extending substantially the internal circumference thereof, and in addition form a support lip extending forward from the entire platform frame 6.

It should be further observed that the length of side frame rail 78, when added to that of spacing member 72 and hinges 74, is such that forward bottom transverse section 80 is located substantially in the same vertical plane as the extended forward edge of side frame 66 and thus when side frame 66 is extended perpendicular to back frame 46 and bottom plate frame 76 is extended substantially perpendicular both to side frame 66 and back frame 46 that the entire structure defines the outer vertices and edges of a rectangular space having a width of 2 and a height and a depth of 1 in proportion, thus, pin ends 60 and forward pin ends 88 are parallel and spaced apart a proportionate distance equal to one half the width of back frame 46.

In the preferred embodiment of the invention the overall length of pontoons 4 constructed as stated above is such that pontoon length bears a ratio of twice the width of back frame 46. Taking, as an idealized example, a pontoon length of twelve feet, it thus should be seen that back frame 46 is six feet in width and three feet in height and depth, and that pin ends 60 and pin ends 88 are three feet apart.

Under this example, transversely mounted to flat top 22 of each pontoon 4 at a spacing as follows are four transverse platform sockets 92. In the preferred embodiment of the invention, using the dimensions above described, the most forward platform socket 92F is two feet aft of the bow of the pontoon 4 and the remaining three platform sockets are spaced at three foot intervals so that the most aft platform socket 92A is one foot foward of the stern of pontoon 4.

The pontoon boat 2 can be readily sized by maintaining the proportions in the ratio above given.

Pontoons 4, having been assembled as above stated, and each of two platform frames 6 being assembled as above described, the platform frame 6's are fastened with pin and socket joints 24 by interconnecting pin ends 60 and 88 of each of the two platform frames 6 respectively to the forward two platform sockets 92 an the aft two platform sockets 92 in such manner that the two platform frames 6 face each other. Two of the provided deck plate 8 are then placed within the bottom plate frames 76, resting upon the provided plate bar support member 90. The third deck plate 8 is positioned between the two platform frames 6 resting upon that portion of support member 90 as extends outward and forward of each of the platform frames 6. It can readily be seen that maintenance of the spacing ratio above described provide space for the installation of three identical deck plates.

A motor is then mounted to motor mount 10 and a safety curtain or chain interconnected between the adjoining side end of the two side frames 66 of each of the two platform frames 6.

Removable frame braces 12 are then affixed, by pinning D ring locking pins 32, extending from a point on outer edges 51 of frames 6 to a point on pontoons 4. Braces 12 serve primarily to dampen vibrations in use.

Side frames 66 have a provided securing tab 110 welded to a lower front corner so that, when frame 6 is erected, tab 110 contacts a mating securing tab 112 affixed to the forward end of each side frame rail 78. A pair of provided holes permits the tabs 110, 112 to be secured using a D ring pin 32, securing the side rails 66 in the open position.

By maintaining the relative proportions above described, the pontoon boat may be broken down into sections by removing all of the D locking ring pins 32. The individual pontoons 4 are then separated into the respective front half section 14 and rear half section 16, providing a total of four half sections each of substantially equal length, and each presenting a flat uniform top surface. It should be noted that, by preserving the proportions stated, the length of each of the pontoon half sections is equal to the width of the back frames 46 of each of the platform frames 6.

The platform frames 6 are folded by first folding each of the side frames 66 in against the back frame 46. Because of the maintenance of the proportion of 1 to 2, side frame length to back frame width, the two side frames 66 fold in end to end forming a single, non-overlapping thickness. Bottom plate frame 76, which is spaced away from back frame 46 by spacing distance 70, equivalent to the thickness of the folded side frame 66, is then folded upward enclosing the side frames 66 and forming an enclosed rectangular structure which is of a size to neatly stack atop the parallel pontoon half section. The three deck plates 8 are then of a size to be stacked atop the two folded platform frames 6, and the entire produces a compact rectangular structure, with the only loose part being identical D ring locking pins 32, of which it should be seen there are twenty-four, and the four frame braces 12.

It should, thus, be seen that the structure disclosed provides for a particularly convenient storage configuration for over-the-road movement on a trailer, and provides for a minimum number of standardized loose parts, minimizing the chance of difficulty in the loss or misplacement of individual small components in the transportation and re-erection of the pontoon boat.

While a particular exemplar configuration has been shown, it should be apparent that the exact mode of interlocking the joints, the exact form of locking pin utilized, and the materials from which the boat is constructed are all susceptible to variation as would be apparent to those skilled in the art and, thus, the invention is not restricted to the specific embodiment disclosed, but rather to that wider range of equivalents given in the claims.

I claim:

1. In a pontoon boat of the type having parallel pontoons upon which is erected a platform structure, the platform structure comprising:

a. a back rail means having a top horizontal rail and a bottom horizontal rail, interconnected with a plurality of vertical support rails;

b. a first and a second side rail frame, hingedly affixed to the back rail means;

c. rectangular bottom plate frame means hingedly affixed to said back rail;

d. said side rail frames folding within said hinged bottom plate frame against a said back rail;

e. said bottom plate frame, said back rail and said side rail frames forming an essentially rectangular space when extended;

f. means for removably affixing said platform structure to said pontoon.

2. The apparatus as described in claim 1 above wherein said bottom plate frame further comprises:

a. bar support means extending inwardly and forwardly from said bottom plate frame for supporting a deck plate.

3. The apparatus as described in claim 2 above further comprising:

a. a removable deck plate supportably contained within said bottom frame contacting said support bar.

4. The apparatus as described in claim 1 above wherein said means for attaching to a pontoon further comprises:

a. first pontoon attachment means fixedly attached to the bottom rail of said back rail means;

b. second pontoon attachment means fixedly attached to said bottom plate frame at a bottom rail distal of said back rail;

c. each said pontoon attachment means further comprising:

1. at least two spacers fixedly attached, extending downward from said bottom rail;

2. the distance between the outer edges of said spacers equal to the distance between said pontoons;
3. a pin pipe fixedly attached to said spacers, spaced from said bottom rail by the thickness of said spacers, extending parallel to and the width of said bottom rail;
4. the ends of said pin pipe extending a distance set by said spacers; and
5. first and second telescoping receiving pipe sections fixed to the tops of a first and second pontoon, for lockably receiving the ends of said pin pipe.

5. A pontoon boat of the type having two parallel pontoons comprising:

a. a first and a second pontoon, each comprising:
1. a closed, buoyant, pontoon half section;
2. first, perpendicular, mating face upon one end of each said pontoon half section;
3. second, angled planar end upon the second end of each said pontoon half section;
4. means for affixing two said pontoon half sections abuttingly perpendicular end to perpendicular end;
5. bendable rubber tab means extending from one angled end of said pontoon half section, defining thereby a stern of said pontoon;
6. detachable, buoyant closed bow means affixable to the angled end of the second said pontoon half section defining thereby a bow of said pontoon;
7. spaced means atop said pontoon for receiving and attaching a first and a second removable platform frame;
8. two, collapsible, removable platform frames, each said platform frame further comprising:
a. vertical back frame means;
b. means affixed to said vertical back frame defining a base thereof, for fixable interconnection for said pontoon;
c. first and second side frame means hingedly affixed to said back frame means having an open position, and having a closed position parallel and adjacent to said back frame means;
d. a base plate supporting frame member means hingedly affixed to said back frame means, in a plane perpendicular to said back frame means, in a plane perpendicular to said side frame means, having an open position, and having a closed position parallel to and adjacent said back frame means, enclosing said side frame means in said closed position;
e. means for mutually affixing said side frame means to said base plate supporting frame member in said open position;
f. said open position defining an essentially rectangular space;
g. means affixed to said base plate supporting frame member distal to said back frame means for interconnection to said pontoon.

6. The apparatus as described in claim 5 above further comprising:

a. Two platform floor plates one of each removably containable within the base plate supporting frame member of each of two said platform frames;
b. a third platform plate member removably containable between said first and said second platform frames.

* * * * *